United States Patent [19]

Mahon

[11] Patent Number: 5,038,949

[45] Date of Patent: Aug. 13, 1991

[54] CHEMICAL BOTTLE ADAPTOR

[76] Inventor: Frank Mahon, 23A Gore Street, Perth, Ontario, Canada, K7H 2L7

[21] Appl. No.: 340,497

[22] Filed: Apr. 19, 1989

[51] Int. Cl.[5] ..... B65D 23/00; B65D 51/24

[52] U.S. Cl. ..... 215/100 R; 210/169

[58] Field of Search ..... 215/1 C, 100 R; 4/512; 210/169, 541

[56] References Cited

U.S. PATENT DOCUMENTS

| | | | |
|---|---|---|---|
| 2,745,755 | 5/1956 | Anderson | 210/100 R X |
| 3,217,917 | 11/1965 | George | 215/1 C X |
| 3,552,567 | 1/1971 | Arp | 4/512 X |
| 3,807,434 | 4/1974 | Rasmussen et al. | 210/169 X |
| 3,957,644 | 5/1976 | Edmonson | 210/169 |
| 4,154,679 | 5/1979 | Farage | 210/169 X |
| 4,473,533 | 9/1984 | Davey | 210/169 X |
| 4,643,881 | 2/1987 | Alexander et al. | 210/169 X |
| 4,725,352 | 2/1988 | Haliotis | 210/169 |
| 4,826,591 | 5/1989 | Macia | 210/169 |
| 4,921,617 | 5/1990 | Antoine et al. | 210/169 X |

*Primary Examiner*—Sue A. Weaver

*Attorney, Agent, or Firm*—Thomas A. O'Rourke

[57] ABSTRACT

An adaptor to convert an ordinary plastic bottle of the kind in which pool chemicals are sold into a device for protecting a swimming pool skimmer against ice damage during the winter.

2 Claims, 1 Drawing Sheet

CHEMICAL BOTTLE ADAPTOR

This invention is concerned with a device for preventing ice damage to a swimming pool skimmer.

U.S. Pat. No. 3,552,567 issued Jan. 5th, 1971, to George F. Arp and entitled Skimmer Protector represents the most pertinent art of which the applicant is aware. It shows a hollow, closed, resilient body with an externally threaded plug for insertion into the internally threaded intake pipe of a skimmer. The concept is that as the pool is made ready for winter, the device is screwed into the intake pipe of a skimmer. As ice forms, it causes the hollow body to collapse rather than causing damage to the skimmer.

The device is simple and effective but it is sold for a relatively high price.

The present invention seeks to achieve the same affect as the device of the above mentioned patent in a simple, effective and inexpensive way.

According to this invention, there is provided an adaptor to convert an ordinary plastic bottle of the kind in which pool chemicals are commonly sold into a skimmer protector.

Conventionally, pool chemicals such as scale inhibitors, algaecides and pH adjusters are sold in flexible plastic bottles having threaded necks sealed with a conventional threaded bottle cap.

The adaptor, according to the present invention, will have a first threaded portion to match the threaded neck of the chemical bottle and cylindrical portion with a surface which is dimensioned to match the inner surface of the intake pipe of a pool skimmer, in a manner removably to retain the bottle therein. In this way, with the adaptor connected to the bottle, the bottle can be secured by the second threaded portion in the skimmer.

Preferably, the surface of the cylindrical portion of the adaptor is threaded to match those intake pipes which have a threaded inner surface.

In one form, the adaptor may constitute the lid of the bottle and have an outer cylindrical surface threaded to fit the intake pipe of the skimmer.

In another aspect of the present invention, the bottle itself has a threaded neck whose length diameter and thread size are selected to match the threads of an intake pipe of a pool skimmer.

A preferred embodiment of the present invention is illustrated in the accompanying drawings in which.

Figure 1:
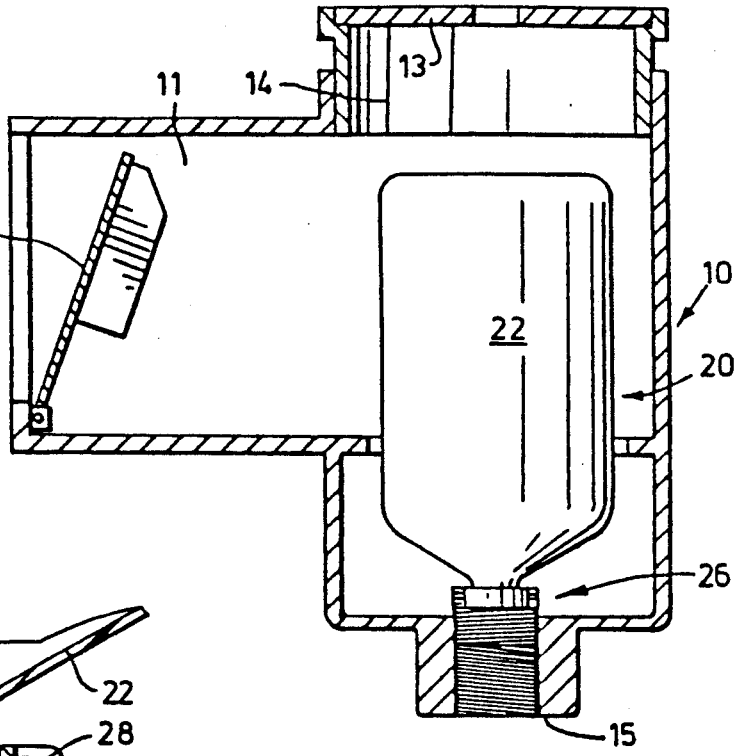
FIG. 1 is a part sectional view of a skimmer with the device of the present invention installed.
Figure 2:
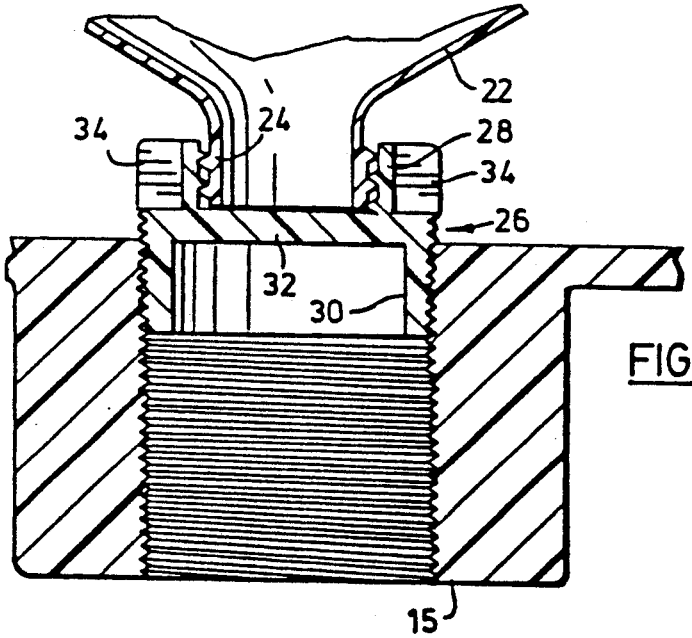
FIG. 2 is a diametrical section through the intake pipe of the skimmer showing the adaptor in place.
Figure 3:
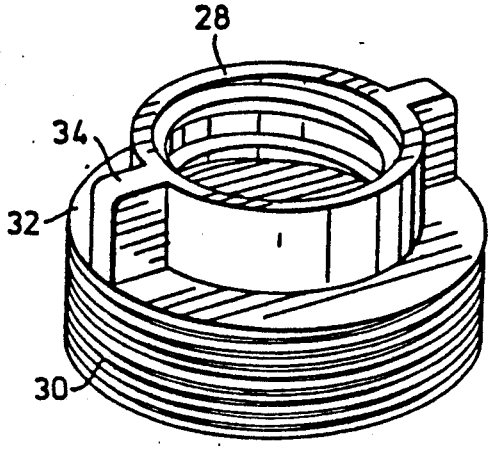
FIG. 3 is a perspective view of the adaptor.

A skimmer 10 has an inlet passageway 11 with a weir 12 leading to an upright chamber 14 which has an intake pipe 15 leading to the pump and filter. Conventionally, a leaf basket is disposed in the chamber 14 and access to that chamber is had through a removable closure 13.

As illustrated in FIG. 1, the leaf basket is removed and a device 20 for protecting the skimmer against ice damage is installed in the intake pipe 15.

The device 20 comprises a bottle of the type in which pool chemicals are conventionally sold. The bottle comprises a body 22 and an externally threaded neck 24. An adaptor 26 has a first cylindrical portion 28 which is internally threaded to match the threads of the neck 24 of the bottle.

The adaptor has a second cylindrical portion 30 on the side of the central disc 32 opposite to that side from which the first cylindrical portion 28 projects. Cylindrical portion 30 is externally threaded to match the internal threads of the intake pipe 15.

A pair of diametrically opposed lugs 34 project radially from the outer surface of the first cylindrical portion 28 and are formed integrally with the adaptor.

It will be recognized that with the empty bottle secured to the adaptor, the adaptor and bottle combination can be fixed in the skimmer and the empty volume of the bottle will accommodate expansion of the ice which would otherwise threaten the integrity of the skimmer.

In removing the device after the risk of ice damage is gone, the bottle would usually be unscrewed from the adaptor and the lugs 34 would be used to assist in removing the adaptor from the intake pipe.

It will be recognized that different embodiments would fall within the scope of the present invention. For example, it would be feasible to use an adaptor which would double as the lid for the bottle. This would be a simple matter, in an arrangement in which the bottle has an externally threaded neck, of providing threads on the exterior surface of the lid to match the threads of the intake pipe. In a situation in which the bottle has an internally threaded neck, an extension of the lid with an externally threaded cylindrical surface would be effective.

In addition, other means are contemplated to retain the bottle in the cylindrical portion 30 in the intake 15. For example, the external threads on the cylindrical portion 30 may be replaced by a smooth or textured surface which is dimensioned to be retained in a suitably surfaced intake 15.

The adaptor may also be replaced by a bottle which is specially dimensioned threadably to engage with the intake 15. In this case, the threads on the neck 24 are selected to match the threads on the intake and the neck itself is made relatively longer than the threaded neck of a conventional pool bottle, for example 1.0 to 1.5 inches or more if desired. It should be recognized that a pool chemical bottle can then be directly threaded into the intake. However, the bottle will not be sealed as in the case with the adaptor of the earlier embodiment, which may not be desirable, in view of the risk of water backing up into the bottle form the intake. However, the bottle neck may easily be sealed with tape or other means to eliminate this risk.

I claim:

1. An adaptor to permit a resilient plastic bottle of the kind in which pool chemicals are sold to be used as a device for protecting a pool skimmer from ice damage and having an externally threaded neck comprises a first threaded portion to match the threaded neck of the bottle and a cylindrical portion dimensioned to match the inner surface of the intake pipe of a pool skimmer in a manner removably to retain each adaptor therein and wherein said intake pipe has a threaded inner surface, said cylindrical portion includes a second threaded portion to match said threaded inner surface, said adaptor comprising an integral body having a disc-like central portion and wherein the first threaded portion comprises an internally threaded cylindrical part projection from one side of said disc-like portion and said second threaded portion comprises an externally threaded cylindrical portion projecting from the opposite side of said disc-like portion.

2. An adaptor as claimed in claim 1 wherein finger grips are provided on said first threaded portion to facilitate removal of said adaptor from the intake pipe of a pool skimmer.

* * * * *